US008172170B2

(12) United States Patent
Vaughan et al.

(10) Patent No.: US 8,172,170 B2
(45) Date of Patent: May 8, 2012

(54) MODULAR CREEL

(75) Inventors: Neil Vaughan, White, GA (US); Mark Honeycutt, Cartersville, GA (US); James Jarrett, Cartersville, GA (US)

(73) Assignee: Columbia Insurance Company, Omaha, NE (US)

( * ) Notice: Subject to any disclaimer, the term of this patent is extended or adjusted under 35 U.S.C. 154(b) by 248 days.

(21) Appl. No.: 12/251,911

(22) Filed: Oct. 15, 2008

(65) Prior Publication Data

US 2010/0090050 A1 Apr. 15, 2010

(51) Int. Cl.
*B65H 49/00* (2006.01)
*D02H 1/00* (2006.01)

(52) U.S. Cl. ..... 242/557; 242/131

(58) Field of Classification Search ..... 242/129.7, 242/597.3, 597.1, 597, 594.6, 594.5, 594.3, 242/594, 593, 591, 131, 131.1, 130, 129.72, 242/129.71, 557, 566, 157 R, 615.3, 157.1, 242/129.8, 149, 419.4; 226/195, 196.1; 139/10, 139/9, 8, 7 A, 6, 2, 7 D, 7 C, 7 B, 7 R, 7 E, 139/7 F, 7 G; 28/193, 209, 211, 212, 214, 28/215, 216

See application file for complete search history.

(56) References Cited

U.S. PATENT DOCUMENTS 626,974 A * 6/1899 Cronin ..... 242/131.1
645,376 A * 3/1900 Slingland et al. ..... 242/131.1
1,653,566 A * 12/1927 Hellawell et al. ..... 242/131.1
2,050,775 A * 8/1936 Alderman ..... 28/172.1
2,099,008 A * 11/1937 Elvin et al. ..... 242/131.1
2,177,855 A * 10/1939 Balch et al. ..... 242/131.1
2,259,079 A * 10/1941 Reiners et al. ..... 242/131.1
2,325,974 A * 8/1943 Pasquerello ..... 242/131.1
2,437,070 A * 3/1948 Bryant ..... 139/97
2,988,299 A * 6/1961 MacDonald ..... 242/156.2
3,321,153 A * 5/1967 Bryan, Jr. ..... 242/131
3,552,693 A * 1/1971 Scherf ..... 242/131
4,065,073 A * 12/1977 Rohner ..... 242/131
4,498,644 A * 2/1985 Kupper et al. ..... 242/131.1
4,822,015 A * 4/1989 Glasman et al. ..... 269/54.1
4,852,824 A * 8/1989 Beitz et al. ..... 242/131.1
5,451,006 A * 9/1995 Smith ..... 242/131.1
5,588,383 A * 12/1996 Davis et al. ..... 112/80.16
6,634,585 B1 * 10/2003 Ingram, III ..... 242/131.1
7,004,415 B2 2/2006 Ingram, III
7,316,366 B2 1/2008 Ingram, III

* cited by examiner

*Primary Examiner* — William E Dondero

(74) *Attorney, Agent, or Firm* — Ballard Spahr LLP

(57) ABSTRACT

A portable creel for organizing yarn packages and directing yarn to a tufting machine. A portable creel provides flexibility for carpet manufactures in that operators can pre-load portable creels with yarn packages for future runs and move them into position when needed. In one aspect, the portable creel comprises an outer frame and a movable inner frame. The inner frame is configured to hold a plurality of yarn packages and the outer frame comprises a plurality of tubes configured to direct the yarn from the yarn packages to a header. The header, in turn, directs the yarn from the portable creel to specific portions of a tufting machine.

19 Claims, 8 Drawing Sheets

MODULAR CREEL

FIELD OF THE INVENTION

This invention relates to a creel for holding yarn packages in a carpet tufting process. More specifically, this invention relates to a highly mobile, compact creel configured for rapid change-out of yarns in a carpet tufting process.

BACKGROUND OF THE INVENTION

A standard creel has a frame provided with a plurality of vertical rows of holders each adapted to hold a respective bobbin comprised of a tubular core and a mass of filament—yarn or thread—wound on the core. A filament is pulled from each bobbin and guided through a respective eye, whence it passes to a warp or weft system of a loom or the like. A standard creel can hold hundreds and even thousands of bobbins, thus space requirement is a problem. Additionally, conventional creel design requires that the tufting machine be placed out of operation during the times an operator is required to change the bobbins on the creel in order to change yarns.

SUMMARY

The invention relates to a portable creel for organizing yarn packages and directing yarn to a tufting machine. A portable creel provides flexibility for carpet manufactures in that operators can pre-load portable creels with yarn packages for future runs and move them into position when needed. In one aspect, the portable creel comprises an outer frame and a movable inner frame.

In one aspect, the outer frame of the portable creel comprises a plurality of substantially upright support members and defines an enclosure. In another aspect, the enclosure is open at one end and defines an interior volume. The portable creel may also have a header mountable thereon a portion of the outer frame. The header defines a plurality of openings configured to direct yarn to a predetermined position on the tufting machine.

In a further aspect, the portable creel further comprises a plurality of tubes, each having a proximal end mounted thereon at least a portion of at least some of the substantially upright support members of the outer frame. In this aspect, each of the tubes extends to and is in communication with a respective opening on the header.

In another aspect, the portable creel also comprises an inner frame that is configured to be matingly positionable within the interior volume of the enclosure. The inner frame may have at least one substantially upright element and a plurality of yarn holders extending therefrom the at least one upright element. The yarn holders are configured to hold a yarn package or bobbin. In one aspect, a portion of each of the yarns that had previously been fed through the tubes and connected through the header to the tufting machine remains exterior to the proximal end of each of the tubes. In this manner, an inner frame may be released from the interior volume and replaced with another inner frame. At this point, and in operation, each of the yarn packages may be connected to the respective yarn end that extends therefrom the respective tube and tied off.

DETAILED DESCRIPTION OF THE FIGURES

These and other features of the preferred embodiments of the invention will become more apparent in the detailed description in which reference is made to the appended drawings wherein.

DETAILED DESCRIPTION OF THE INVENTION

Figure 1:
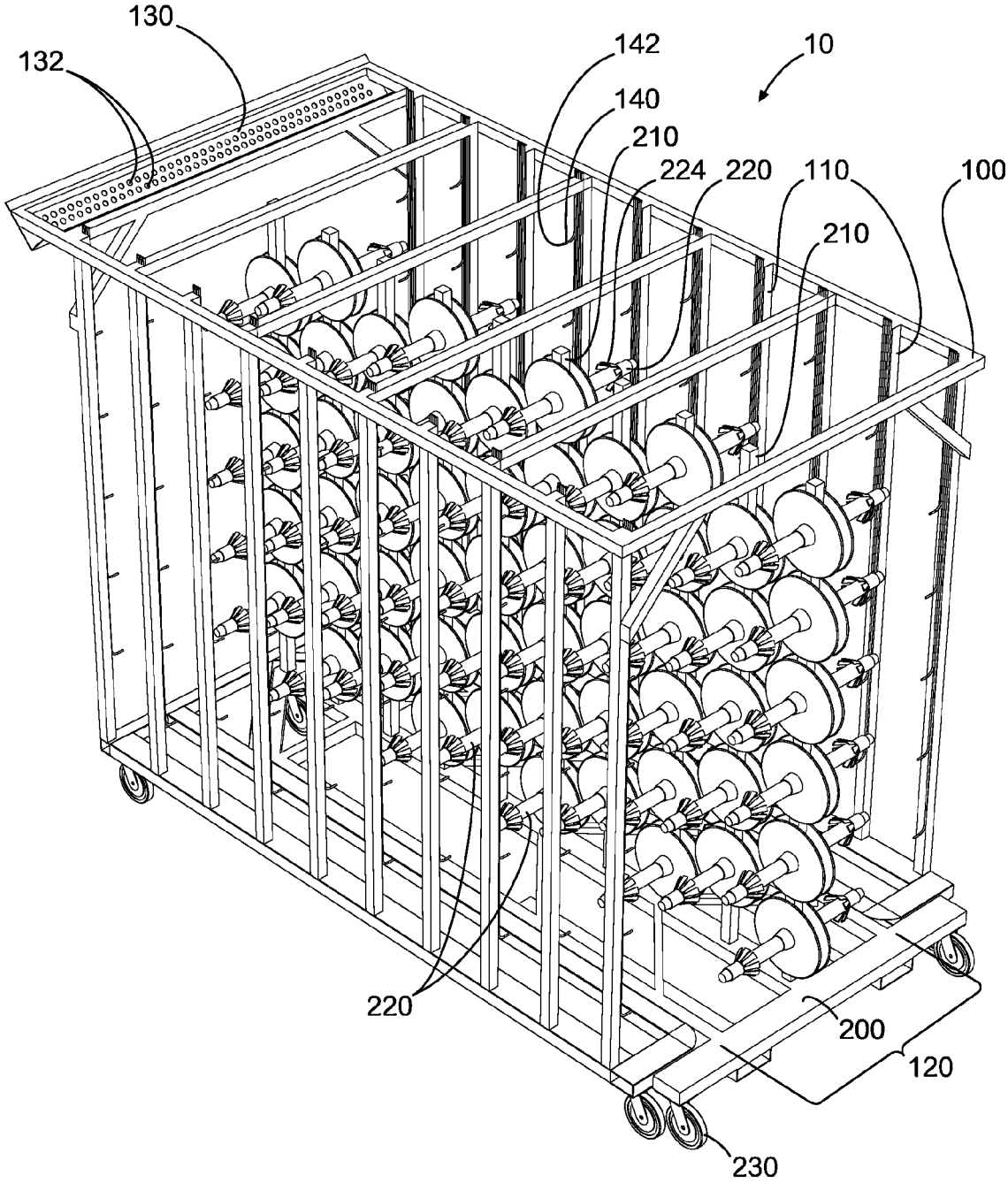
FIG. 1 is a perspective view of the portable creel according to one aspect of the present invention.

The present invention can be understood more readily by reference to the following detailed description, examples, drawing, and claims, and their previous and following description. However, before the present devices, systems, and/or methods are disclosed and described, it is to be understood that this invention is not limited to the specific devices, systems, and/or methods disclosed unless otherwise specified, as such can, of course, vary. It is also to be understood that the terminology used herein is for the purpose of describing particular aspects only and is not intended to be limiting.

The following description of the invention is provided as an enabling teaching of the invention in its best, currently known embodiment. To this end, those skilled in the relevant art will recognize and appreciate that many changes can be made to the various aspects of the invention described herein, while still obtaining the beneficial results of the present invention. It will also be apparent that some of the desired benefits of the present invention can be obtained by selecting some of the features of the present invention without utilizing other features. Accordingly, those who work in the art will recognize that many modifications and adaptations to the present invention are possible and can even be desirable in certain circumstances and are a part of the present invention. Thus, the following description is provided as illustrative of the principles of the present invention and not in limitation thereof.

As used throughout, the singular forms "a," "an" and "the" include plural referents unless the context clearly dictates otherwise. Thus, for example, reference to "a tube" can include two or more such tubes unless the context indicates otherwise.

Ranges can be expressed herein as from "about" one particular value, and/or to "about" another particular value. When such a range is expressed, another aspect includes from the one particular value and/or to the other particular value. Similarly, when values are expressed as approximations, by use of the antecedent "about," it will be understood that the particular value forms another aspect. It will be further understood that the endpoints of each of the ranges are significant both in relation to the other endpoint, and independently of the other endpoint.

As used herein, the terms "optional" or "optionally" mean that the subsequently described event or circumstance may or may not occur, and that the description includes instances where said event or circumstance occurs and instances where it does not.

In one embodiment, the invention relates to a portable creel 10 for organizing yarn packages 20 and directing yarn to a tufting machine. The portable creel 10 provides flexibility for carpet manufactures in that operators can pre-load portable creels with yarn packages 20 for future runs and move them into position when needed. In one aspect, the portable creel 10 comprises an outer frame 100 and a selectively movable inner frame 200.

In one aspect, the outer frame 100 of the portable creel comprises a plurality of substantially upright support members 110 and defines an enclosure 120. In another aspect, the enclosure 120 is open at one end and defines an interior volume. It is contemplated that the outer frame is fixed relative to the tufting machine. However, the outer frame can also be portable and movable relative to the tufting machine. In this aspect, the outer frame and inner frame may move together as an assembled unit.

Additionally, in another aspect, the portable creel also has a header 130 mountable thereon a portion of the outer frame. The header 130 defines a plurality of openings 132 configured to direct yarn to a predetermined position on the tufting machine. Headers, as such, are well known in the art and it is contemplated that any commercially available header will suffice with the portable creel.

In another aspect, the header may be equipped with a substantially elongate slider 134. The slider 134 is mountable thereon the header 130 and defines a plurality of slider openings 136. The slider is configured to translate in a longitudinal direction from a first position in which the slider openings are substantially coaxial with at least some of the openings 132 in the header, to a second position in which the slider openings and the openings in the header are substantially staggered. The slider may be used during a creel changeout by positioning the slider in the second position to pinch the plurality of yarns that are passing through the header between the header and the slider. Once the slider is in the second position and the yarn is thus pinched, the yarn ends may be cut and held into place without the need to re-thread them through the header after the changeout. In one aspect, the slider is manually actuated, using a mechanical toggle 138, or the like. However, it is also contemplated that the slider may be actuated mechanically, using a solenoid or the like.

Figure 2:
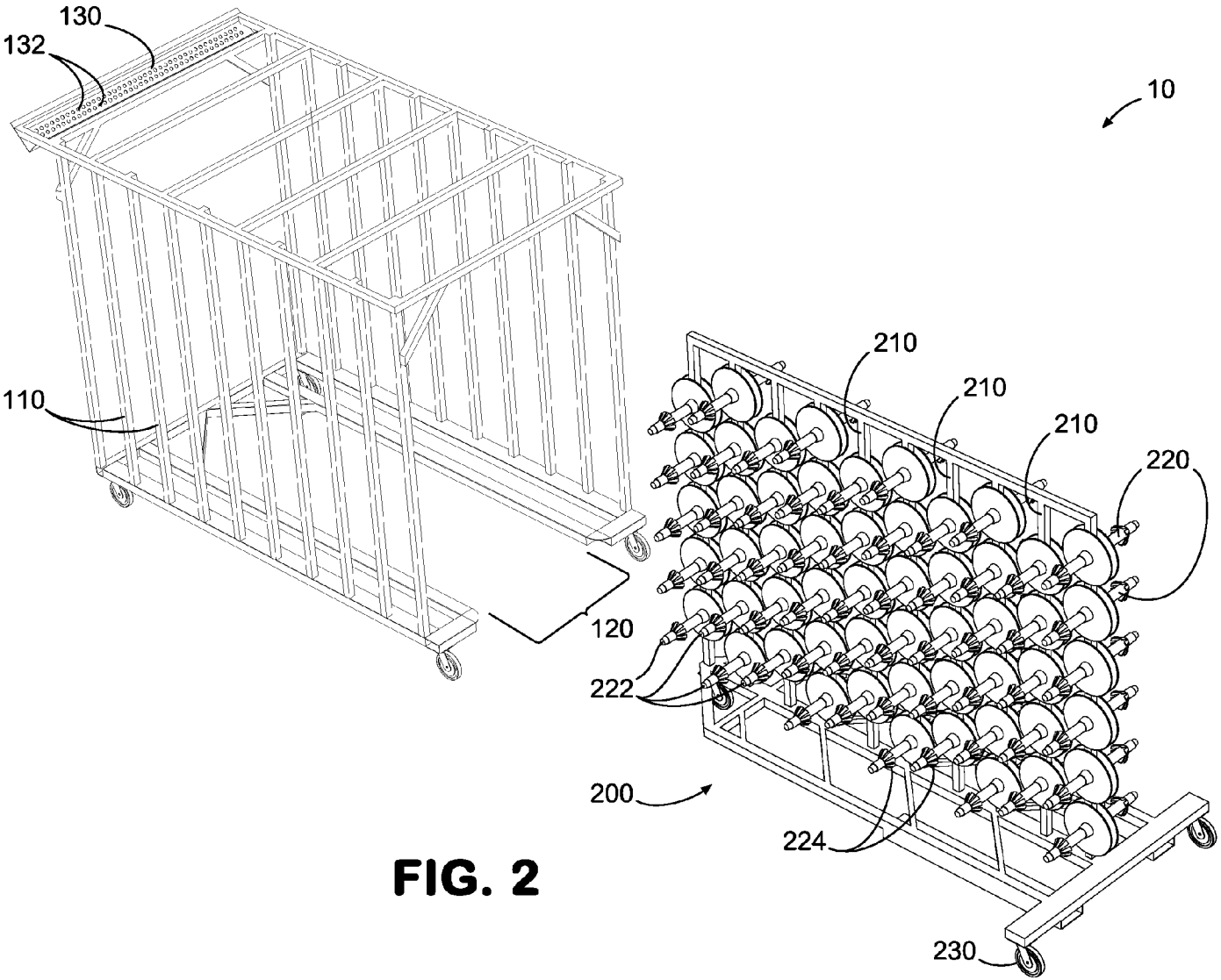
FIG. 2 is a perspective view of the portable creel of FIG. 1, illustrating the inner frame outside of the enclosure defined by the outer frame.
Figure 3A:
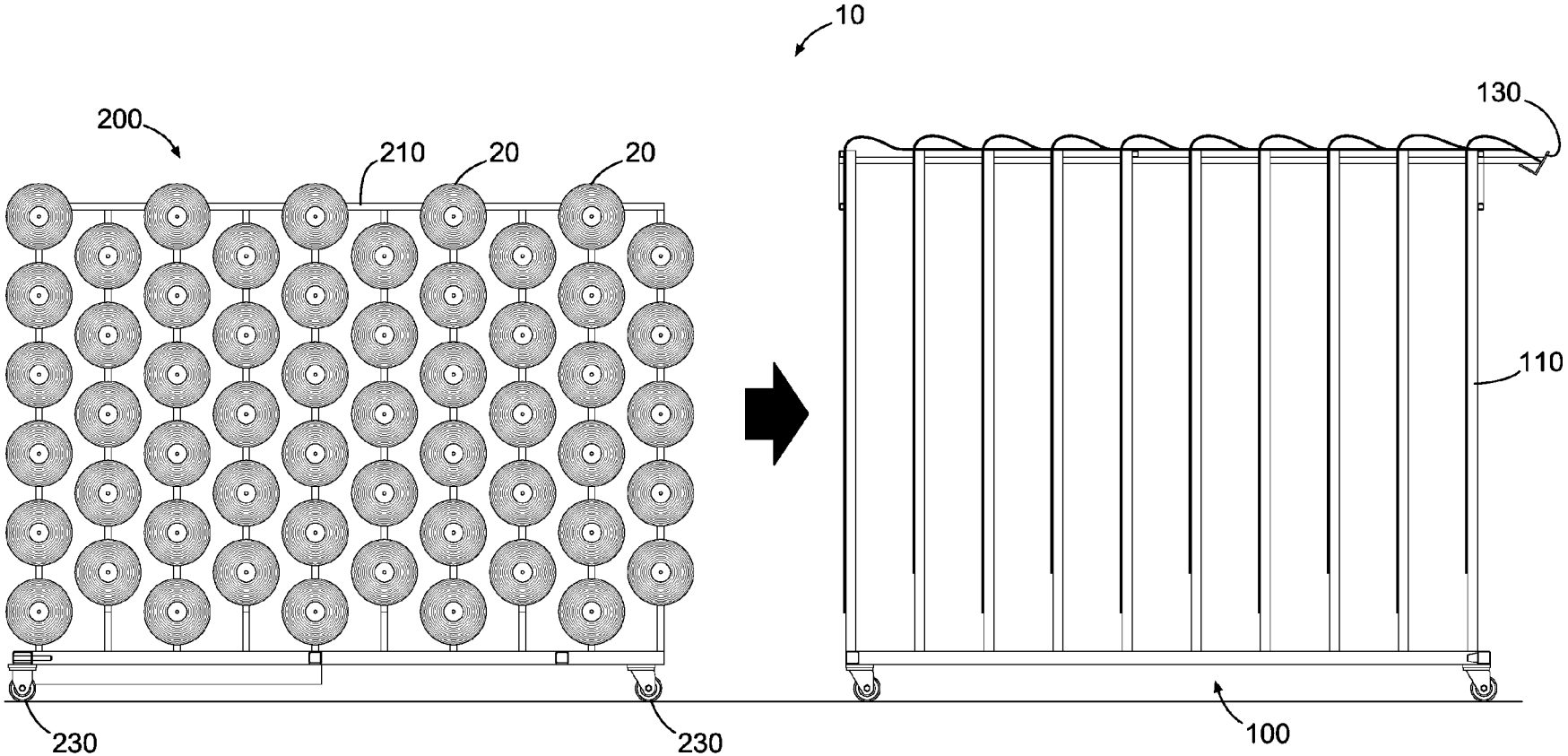
FIG. 3A is a right side elevational view of the portable creel of FIG. 1, illustrating the inner frame moving into the enclosure defined by the outer frame.
Figure 3B:
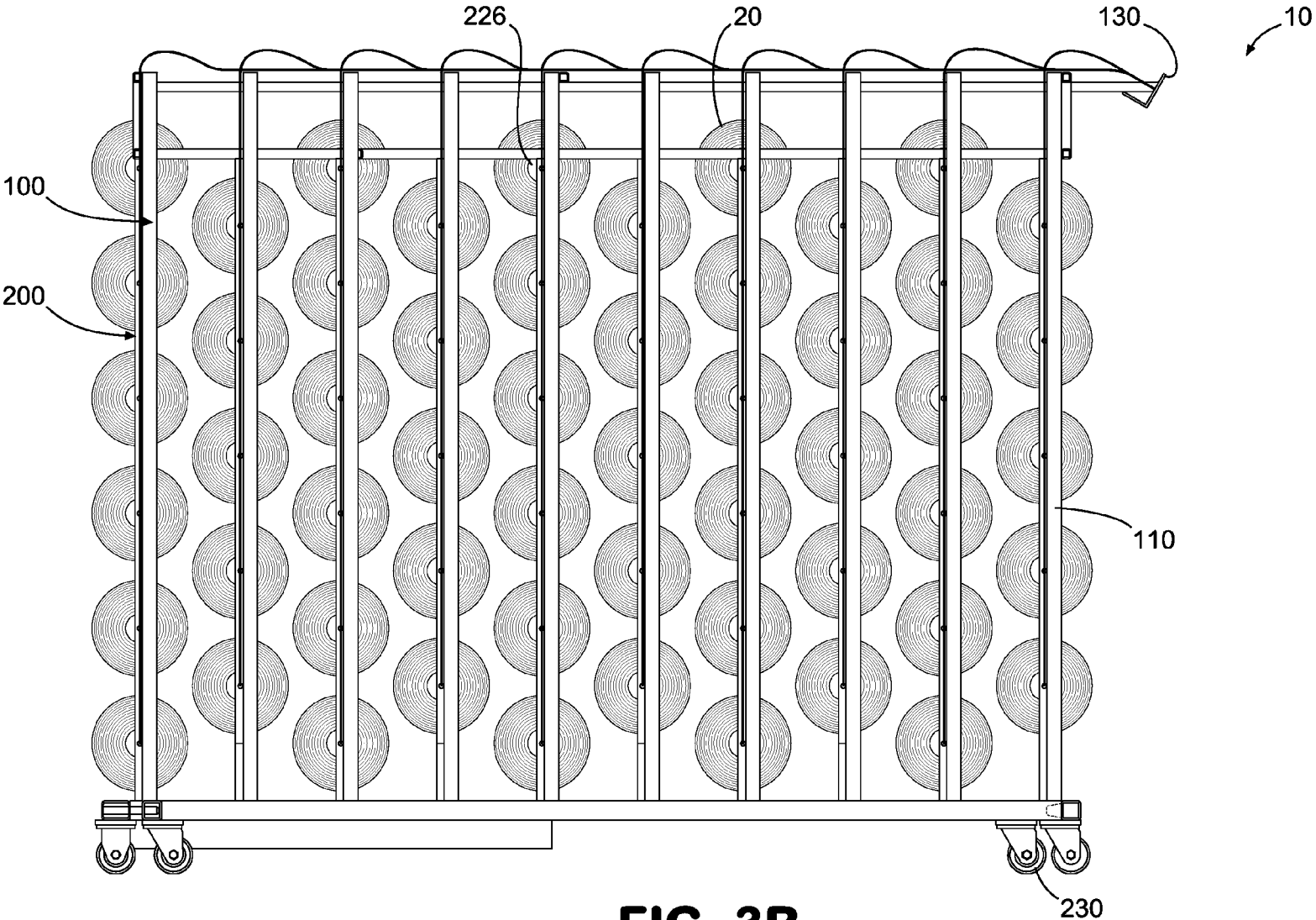
FIG. 3B is a right side elevational view of the portable creel of FIG. 1, illustrating the inner frame disposed within the enclosure defined by the outer frame. The tubes of the portable creel were omitted for optical clarity.

As illustrated in FIG. 2, the portable creel 10 further comprises a plurality of tubes 140. Each tube has a proximal end 142 mounted thereon at least a portion of at least some of the substantially upright support members 110 of the outer frame 100. In this aspect, each of the tubes 140 extends to and is in communication with a respective opening on the header. As known in the art, yarn may be fed through the tubes, through the header 130, and to the tufting machine.

In one aspect, the portable creel also comprises an inner frame 200 matingly positionable within the interior volume of the enclosure. The inner frame may have at least one substantially upright element 210 and a plurality of yarn holders 220 that extend outwardly therefrom the at least one upright element 210. The yarn holders 220 are configured to hold a yarn package or bobbin. In one aspect, the yarn holders comprise a rod 222 sized and shaped to fit within the center cavity 226 of the yarn package 20. In another aspect, at least one spring clip 224 that are configured to enable a friction fit with the center cavity of the yarn package can be connected to the rod 222.

Optionally, each of the yarn holders can be positioned to be substantially collinear with and spaced therefrom the proximal end 142 of one of the tubes mounted on a substantially upright support member when the inner frame is operably positioned within the interior volume of the enclosure. In operation, a distal end portion of each of the yarns that had previously been fed through the tubes and connected through the header to the tufting machine can be allowed to remain exterior to the proximal end of each of the tubes after the yarns are cut. In this manner, an inner frame may be released from the interior volume and replaced with another inner frame 200. At this point, each of the yarn packages may be connected to the respective yarn ends that extend therefrom the respective tube and operatively tied off.

Figure 4B:
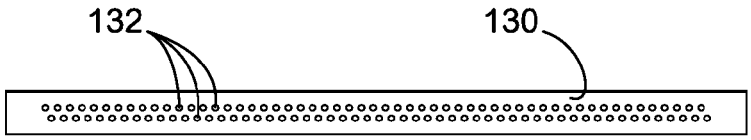
FIG. 4B is a front elevational view of one aspect of a header for a portable creel according to one aspect of the present invention.
Figure 4A:
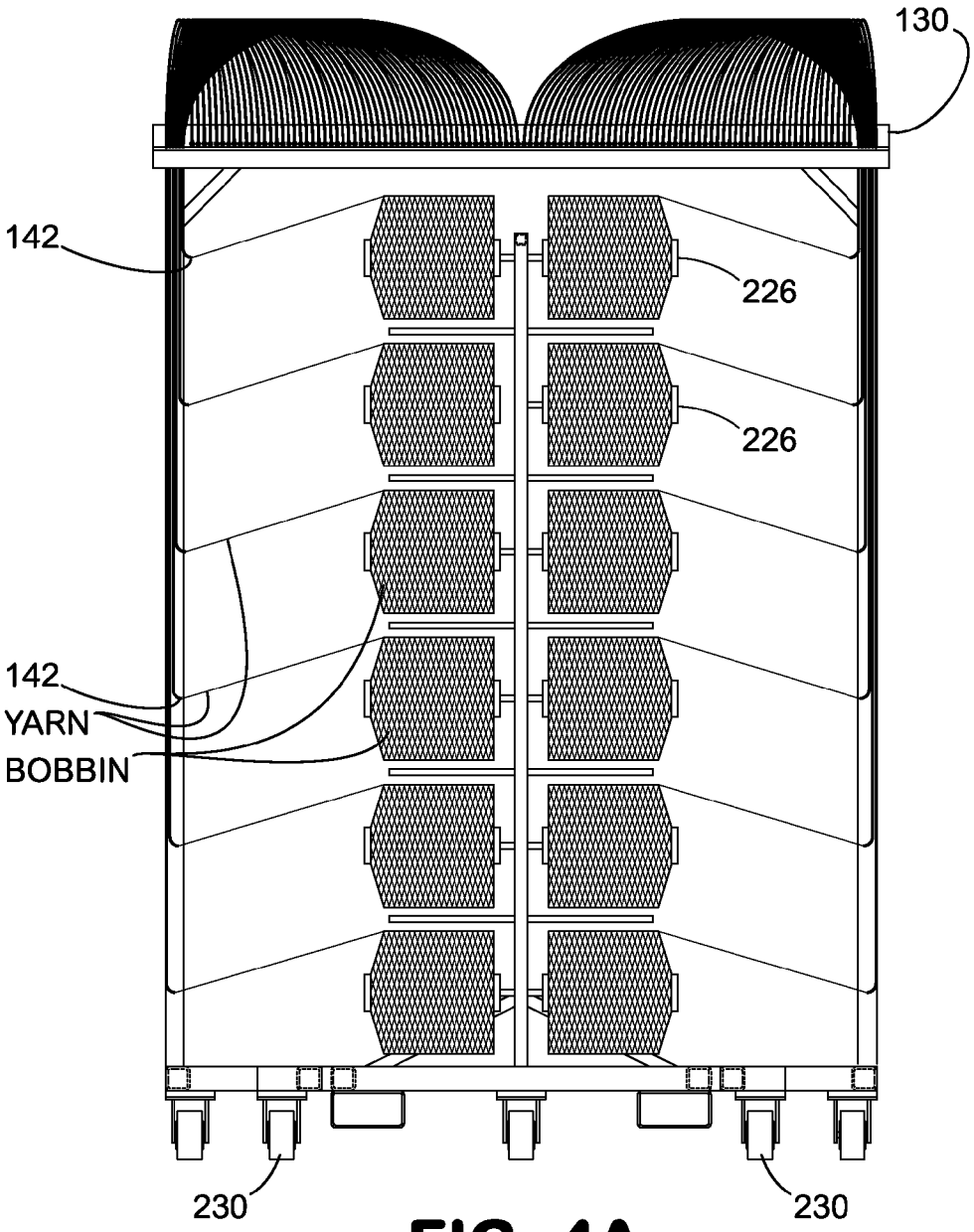
FIG. 4A is a rear elevational view of the portable creel of FIG. 1, showing the yarn holders and the tubes.
Figure 5:
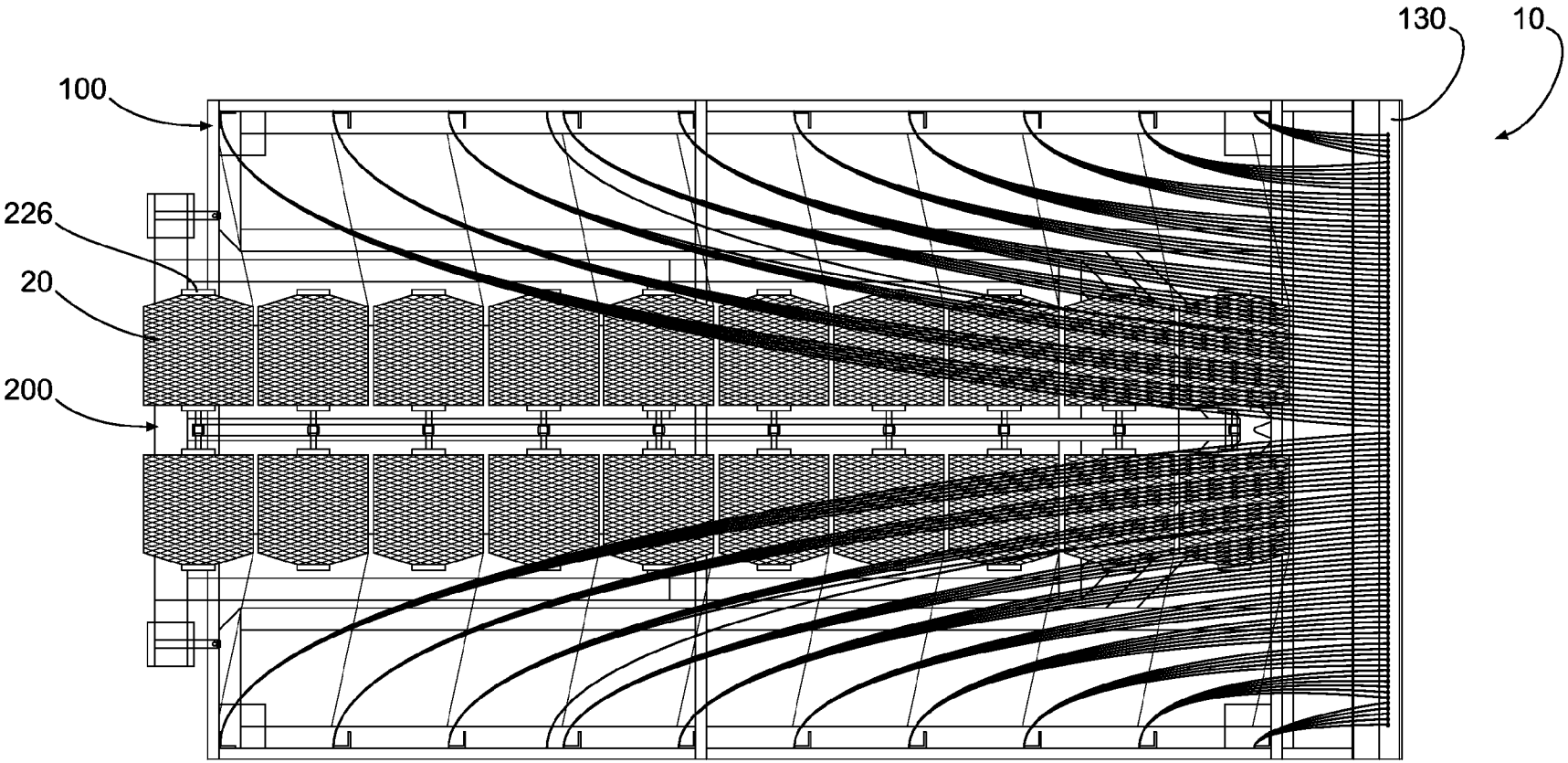
FIG. 5 is a top elevational view of the portable creel of FIG. 1.
Figures 6, 7:
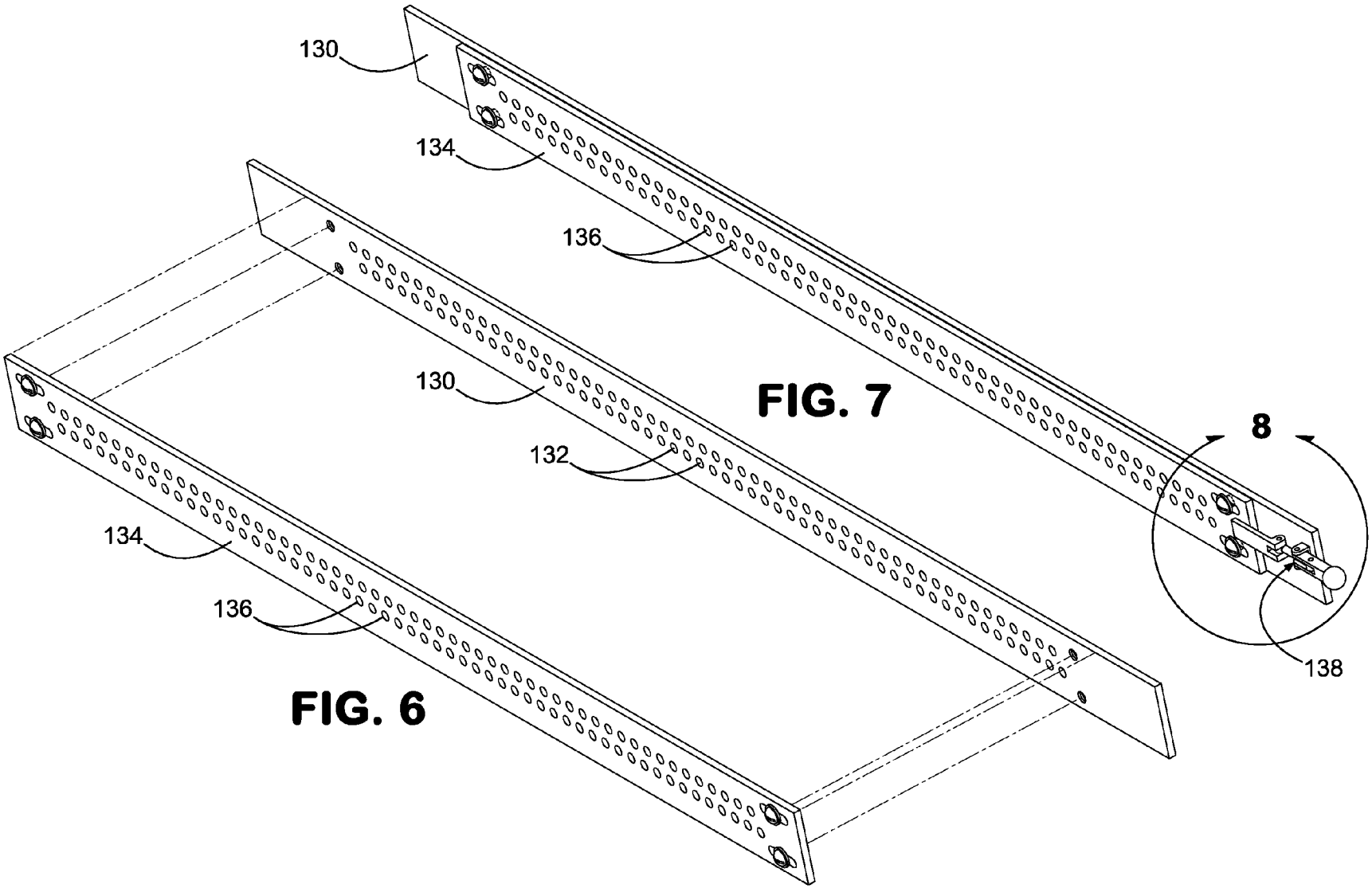
FIG. 6 is an exploded perspective view of one aspect of the header, illustrating a slider mechanism.
FIG. 7 is a perspective view of the slider of FIG. 6, mounted thereon the header, illustrating a mechanical toggle.
Figure 8:
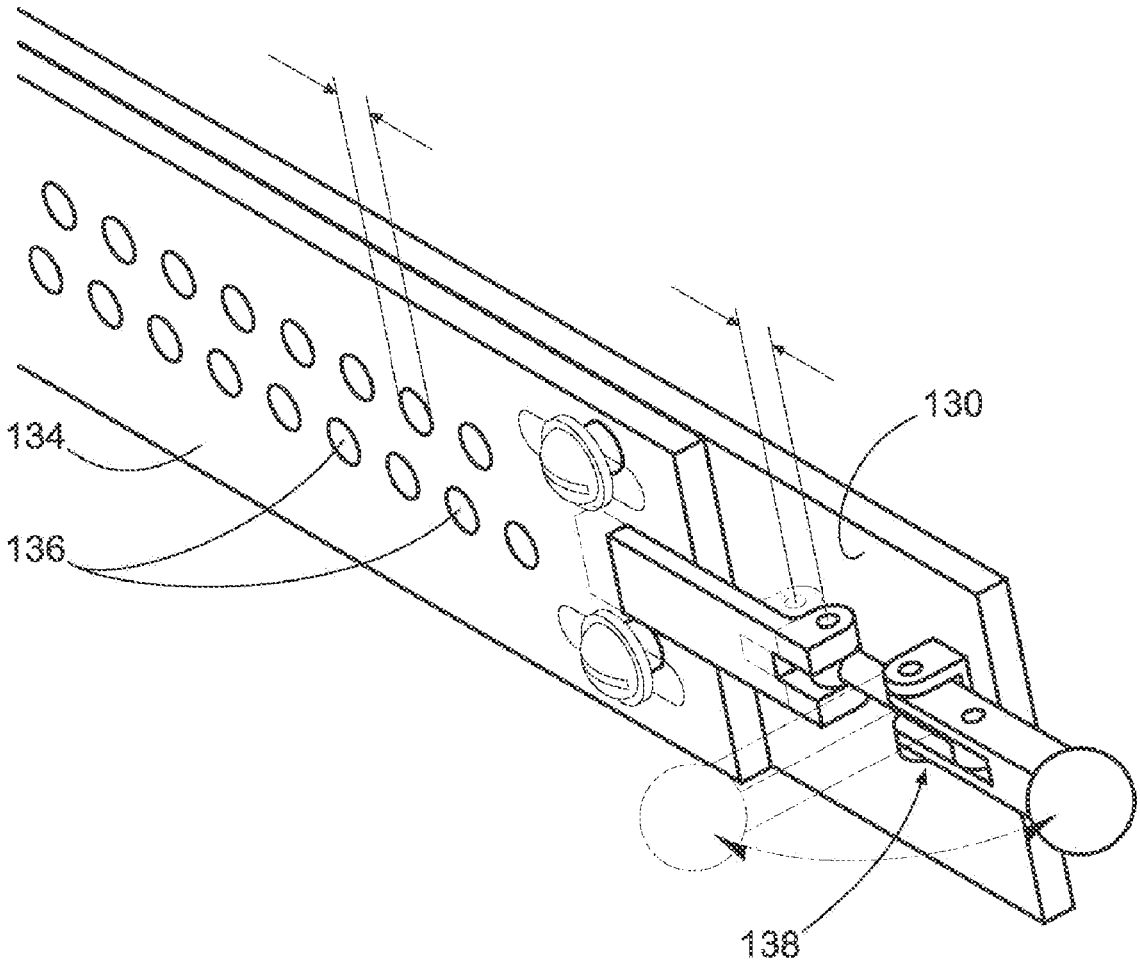
FIG. 8 is a section view of the mechanical toggle of FIG. 7.

In yet another aspect, the inner frame comprises a plurality of upright elements. In this aspect, each upright element comprises a plurality of yarn holders. The substantially upright support members of the outer frame may comprise pairs of opposed substantially upright support members spaced from each other by the interior volume of the enclosure 120. In this aspect, each upright element 210 of the inner frame is coplanar with a corresponding pair of substantially upright support members. Additionally, the plurality of yarn holders on each of the upright elements comprises a plurality of opposed pairs of yarn holders 220. Each yarn holder of the pair of yarn holders is operably positioned to substantially face a respective substantially upright support member. In this fashion, as illustrated in FIG. 4A, each yarn holder is substantially adjacent, yet spaced from, a respective proximal tube end.

In one exemplary aspect, the inner frame of the portable creel is selectively movable. As known in the art, any conventional method of moving a frame are contemplated. For example and without limitation, the inner frame 200 may comprise a plurality of casters 230 on a lower portion of the frame that enable the frame to roll. Similarly, the outer frame may also be selectively movable and may also comprise a plurality of casters configured to enable the outer frame to roll. As mentioned herein above, the outer frame may also be positioned in fixed relation with the tufting machine.

Although several embodiments of the invention have been disclosed in the foregoing specification, it is understood by those skilled in the art that many modifications and other embodiments of the invention will come to mind to which the invention pertains, having the benefit of the teaching presented in the foregoing description and associated drawings. It is thus understood that the invention is not limited to the specific embodiments disclosed hereinabove, and that many modifications and other embodiments are intended to be included within the scope of the appended claims. Moreover, although specific terms are employed herein, as well as in the claims which follow, they are used only in a generic and descriptive sense, and not for the purposes of limiting the described invention, nor the claims which follow.

The invention claimed is:

1. A portable creel for organizing yarn packages and directing yarn to a tufting machine, the portable creel comprising:

an outer frame comprising a plurality of substantially upright support members and defining an enclosure, the enclosure being open at one end, and defining an interior volume, wherein the outer frame further comprises a plurality of casters configured to enable the outer frame to roll;

a header mountable thereon a portion of the outer frame, the header defining a plurality of openings configured to direct yarn to a predetermined position on the tufting machine;

a plurality of tubes, each tube having a proximal end mounted thereto at least a portion of at least some of the substantially upright support members, wherein each of the tubes extends to and is in communication with a respective opening on the header; and an inner frame matingly positionable within the interior volume of the enclosure, the inner frame having at least one substantially upright element and a plurality of yarn holders extending therefrom the at least one upright element, each yarn holder configured to hold a yarn package, wherein each of the yarn holders is substantially collinear with and spaced therefrom the proximal end of a tube mounted on a substantially upright support member when the inner frame is operably positioned within the interior volume of the enclosure.

2. The portable creel of claim 1, wherein the outer frame is positionally fixed relative to the tufting machine.

3. The portable creel of claim 1, wherein the yarn holders each comprise a rod configured to be positioned therethrough a center cavity of a yarn package.

4. The portable creel of claim 3, wherein each of the yarn holders further comprise spring clips mounted thereon a portion of each rod configured to hold the yarn package in frictional engagement with the yarn holder.

5. The portable creel of claim 1, wherein the inner frame comprises a plurality of upright elements, wherein each upright element comprises a plurality of yarn holders.

6. The portable creel of claim 5, wherein the substantially upright support members of the outer frame comprise pairs of opposed substantially upright support members spaced from each other by the interior volume of the enclosure.

7. The portable creel of claim 6, wherein each upright element is coplanar with a corresponding pair of substantially upright support members.

8. The portable creel of claim 7, wherein the plurality of yarn holders on each of the upright elements comprises a plurality of opposed pairs of yarn holders and wherein each of the yarn holder of the pair of yarn holders is operably positioned to substantially face a respective substantially upright support member.

9. The portable creel of claim 1, wherein the inner frame further comprises a plurality of casters configured to enable the inner frame to roll.

10. The portable creel of claim 1, wherein the inner frame further comprising means for allowing the inner frame to be moved relative to the outer frame.

11. The portable creel of claim 1, wherein the outer frame further comprises means for allowing the outer frame to be moved relative to the tufting machine.

12. The portable creel of claim 1, further comprising a substantially elongate slider mountable thereon the header, wherein the slider defines a plurality of slider openings, and wherein slider is configured to translate in a longitudinal direction from a first position in which the slider openings are substantially coaxial with at least some of the openings in the header, to a second position in which the slider openings and the openings in the header are substantially staggered.

13. The portable creel of claim 1, wherein when the inner frame is matingly positioned within the enclosure of the outer frame, the outer frame and the inner frame are movable together as a unit.

14. A portable creel for organizing yarn packages and directing yarn to a tufting machine, the portable creel comprising:

an outer frame defining an enclosure, and comprising a means for rolling the outer frame relative to the tufting machine;

a header mountable thereon a portion of the outer frame, the header defining a plurality of openings configured to direct yarn to a predetermined position on the tufting machine;

a plurality of tubes, each tube having a proximal end mounted thereto a portion of the outer frame, wherein each of the tubes extends to and is in communication with a respective opening on the header; and an inner frame selectively matingly positionable within the enclosure of the outer frame, the inner frame having at least one substantially upright element and a plurality of yarn holders extending outwardly therefrom the at least one upright element, each yarn holder configured to hold a yarn package, wherein each of the yarn holders is substantially collinear with and spaced therefrom the proximal end of a tube mounted on the outer frame when the inner frame is operably positioned within the enclosure.

15. The portable creel of claim 14, wherein the outer frame has a plurality of substantially upright support members.

16. The portable creel of claim 15, wherein the proximal end of each tube is mounted to a portion of a respective substantially upright support members or the outer frame.

17. The portable creel of claim 14, further comprising a substantially elongate slider mountable thereon the header, wherein the slider defines a plurality of slider openings, and wherein slider is configured to translate in a longitudinal direction from a first position in which the slider openings are substantially coaxial with at least some of the openings in the header, to a second position in which the slider openings and the openings in the header are substantially staggered.

18. The portable creel of claim 14, wherein when the inner frame is matingly positioned within the enclosure of the outer frame, the outer frame and the inner frame are movable together as a unit.

19. A portable creel for organizing yarn packages and directing yarn to a tufting machine, the portable creel comprising:

an outer frame comprising a plurality of substantially upright support members and defining an enclosure, the enclosure being open at one end, and defining an interior volume;

a header mountable thereon a portion of the outer frame, the header defining a plurality of openings configured to direct yarn to a predetermined position on the tufting machine;

an inner frame matingly positionable within the interior volume of the enclosure, the inner frame having at least one substantially upright element and a plurality of yarn holders extending therefrom the at least one upright element, each yarn holder configured to hold a yarn package; and means for moving the outer frame relative to the tufting machine, wherein the means for moving the outer frame comprises moving the outer frame when the inner frame is operably positioned within the enclosure.

* * * * *